US007540717B2

(12) United States Patent
Sheng et al.

(10) Patent No.: US 7,540,717 B2
(45) Date of Patent: Jun. 2, 2009

(54) MEMBRANE NANOPUMPS BASED ON POROUS ALUMINA THIN FILMS, MEMBRANES THEREFOR AND A METHOD OF FABRICATING SUCH MEMBRANES

(75) Inventors: Ping Sheng, Hong Kong (CN); Ning Wang, Hong Kong (CN); Jianying Miao, Hong Kong (CN); Zhiyu Yang, Hong Kong (CN); Shihe Yang, Hong Kong (CN); Xinyi Zhang, Hefei (CN)

(73) Assignee: The Hong Kong University of Science and Technology, Hong Kong (HK)

( * ) Notice: Subject to any disclaimer, the term of this patent is extended or adjusted under 35 U.S.C. 154(b) by 330 days.

(21) Appl. No.: 11/144,100

(22) Filed: Jun. 3, 2005

(65) Prior Publication Data

US 2006/0275138 A1 Dec. 7, 2006

(51) Int. Cl.
*F04B 37/02* (2006.01)
*H01L 21/20* (2006.01)
*C21C 1/06* (2006.01)

(52) U.S. Cl. ..... 417/48; 417/53; 75/330; 438/478

(58) Field of Classification Search ..... 417/48, 417/49, 50, 53, 54, 55; 313/231, 359.1, 545, 313/566; 75/255; 438/478
See application file for complete search history.

(56) References Cited

U.S. PATENT DOCUMENTS

| | | | | |
|---|---|---|---|---|
| 6,139,713 | A * | 10/2000 | Masuda et al. | 205/206 |
| 7,086,839 | B2 * | 8/2006 | Kenny et al. | 417/48 |
| 2004/0241004 | A1 * | 12/2004 | Goodson et al. | 417/48 |
| 2007/0201987 | A1 * | 8/2007 | Hasegawa et al. | 417/48 |
| 2008/0014431 | A1 * | 1/2008 | Lashmore et al. | 428/315.5 |

* cited by examiner

*Primary Examiner*—Charles G Freay
(74) *Attorney, Agent, or Firm*—Heslin Rothenberg Farley & Mesiti PC

(57) ABSTRACT

A technique has been developed to fabricate micro- or nanopumps based on porous alumina thin films. The main body of the nanopump consists of a porous alumina thin film (containing nano-sized channels of about 40-300 nm in diameter) with conductive surfaces (e.g. Au coating layers) on both sides of the film. Through the fabrication of nanochannels in (the alumina films) and the subsequent annealing and surface activation processes, high-efficiency micro- or nanopumps can be made. The nanofluidic flow through the nanochannels of the alumina thin films is driven by an electric field with no moving parts. The flow rate (up to 50 millilitres/(min·cm$^2$)) of water through the alumina thin film can be continuously tuned through the intensity of the electric field, i.e., the DC electric potential applied across the nanochannels.

26 Claims, 8 Drawing Sheets

MEMBRANE NANOPUMPS BASED ON POROUS ALUMINA THIN FILMS, MEMBRANES THEREFOR AND A METHOD OF FABRICATING SUCH MEMBRANES

FIELD OF THE INVENTION

The invention relates to membranes for micro- or nanopumps, to fabricating such membranes, and to micro- or nanopumps and their fabrication, for instance those controllable through an applied electric potential.

BACKGROUND

Microfluidics is considered an important research field, with growing applications potential and promising markets in many technological applications, such as in fluid control devices, medical testing devices (e.g. DNA and protein analysis and drug discovery), etc. Micropumps are one of the most important microfluidic components.

There are generally two types of micropumps, both mainly made by micromachining technology: mechanical pumps (using moving parts such as check valves and oscillating membranes) and non-mechanical pumps (converting electrical energy into kinetic energy in the fluid). Mechanical micropumps are typically of a size in the range of millimetres (many in the range of centimetres, with large flow rates of >10 ml/min). Non-mechanical pumps are typically orders of magnitude smaller, at least in the fluid pumping direction.

While mechanical pumps usually have difficulty in controlling flow rates, especially in low flow-rate applications (e.g., drug delivery), non-mechanical pumps can usually serve as accurate low flow-rate pumps. However, non-mechanical pumps usually have the disadvantages of high-voltage operation (typically hundreds of volts) and low maximum flow rates.

Various kinds of non-mechanical micropumps have been developed in recent years, e.g. electro-dialysis pumps, electro-kinetic pumps, electro-hydrodynamic pumps, magneto-hydrodynamic pumps, phase transfer pumps, electro-wetting pumps and electrochemical pumps.

Electro-dialysis is capable of transporting ionic compounds from one solution to another, for example salts or acids from a dilute solution to a concentrate solution by applying an electric current. Anions and cations pass through anion exchange membranes and cation exchange membranes, respectively. One common use for such a cell is in seawater desalination.

For electro-kinetic pumps, an electrical field is used to pump the fluid, using one of two mechanisms for the electro-kinetic phenomenon: electrophoresis (using an electrical field to drive charged species in a fluid) and electro-osmosis (pumping the fluid through a charges surface of channels in a substrate under an electrical field). Different micropumps have their advantages and specific application fields.

Electro-osmosis has been used to deliver buffer solutions and separating molecules like DNA or proteins. One such pump is described in D. J. Harrison, et al. *Proc. of Inter. Conf. On Solid-state Sensors and Actuators Transducers,* 1991, p. 792. This was an electro-osmosis pump integrated on silicon and apparently capable of generating a fluid velocity of 100 μm/s using a field strength of 150 V/cm.

Other published prior art includes U.S. Patent Publication No. 6,471,688 B1, issued to Derek J. Harper and Charles F. Milo on 29 Oct. 2002, "Osmotic pump drug delivery systems and methods. The osmotic pump structure described therein uses two semi-permeable membranes of a cellulose acetate composition, one of which is initially covered with an impermeable membrane, such as: titanium, stainless steel, platinum, platinum-iridium, polyethylene, PET or PETG, which is pierced after implantation of the device.

Further, International Patent Application Publication WO 2004/073822 A2, published in the name of Sophion Bioscience A/S on 2 Sep. 2004, "sieve EOF pump" describes an electro-osmotic flow (EOF) pump. A hollow housing has two ports at one end connecting to an internal chamber. The chamber is divided into two compartments by a membrane made from silicon, with one port connecting to each compartment. The surface of the membrane is made hydrophilic by thermal or chemical oxidation, or by deposition of a hydrophilic material such as silicon oxide, glass, silica or alumina. The pore sizes of the membrane are around 0.8 μm in diameter. Electrodes sit on opposing surfaces of the chamber on opposing sides of the membrane to create an electric field to pump an ionic liquid from one compartment to the other.

Additionally, U.S. Patent Publication No. 6,784,007 B1, issued to Tatsuya Iwasaki and Tohru Den on 31 Aug. 2004, "Nano-structures, process for preparing nano-structures and devices", describes a technique, using anodic oxidation, for preparing porous alumina thin films which contain different sized nanopores. The films are for use in light emitting devices, optical devices and magnetic devices.

It is an aim of the present invention to provide a new micro- or nanopump membrane and micro- or nanopump and a new micro- or nanopump fabrication method.

SUMMARY

According to one aspect of the present invention, there is provided a membrane for a micropump or nanopump. The membrane has a membrane body, channels in the body, a first electrode and a second electrode. The channels pass through the body, with the first electrode mounted at one end of the channels and the second electrode mounted at the other end.

According to another aspect of the present invention, there is provided a micropump or a nanopump. The pump comprises: a housing, a pump membrane, and a voltage source. The housing contains a first fluid chamber and a second fluid chamber. The pump membrane is a membrane according to the first aspect and separates the first and second fluid chambers. The voltage source is connected between the first and second electrodes.

The voltage source may be used to apply a DC potential between the two electrodes to control the flow rate of a fluid through the channels, from the first fluid chamber to the second fluid chamber.

According to again another aspect of the present invention, there is provided a method of fabricating a membrane for a micro- or nanopump. The method comprises: annealing a membrane body; activating surfaces of channels through the membrane body; and mounting electrodes on opposing surfaces of the membrane body.

BRIEF DESCRIPTION OF THE DRAWINGS

The invention may be further understood from the following description on non-limitative examples, with reference to the accompanying drawings, in which:—

SUMMARY OF THE PRESENT INVENTION

Embodiments of the present invention include electro-kinetic nanopumps using the electro-osmosis effect in nanochannels, especially in a porous alumina film. The present invention also provides a method for fabricating nanopumps, for instance based on porous alumina thin films containing nanochannels. The nanopumps can be driven by a DC electric potential. The flow rate (e.g. up to 50 millilitres/[min·cm$^2$] of fluid at 30V through an alumina thin film) can be continuously tuned through the magnitude of applied voltage.

Figure 1:
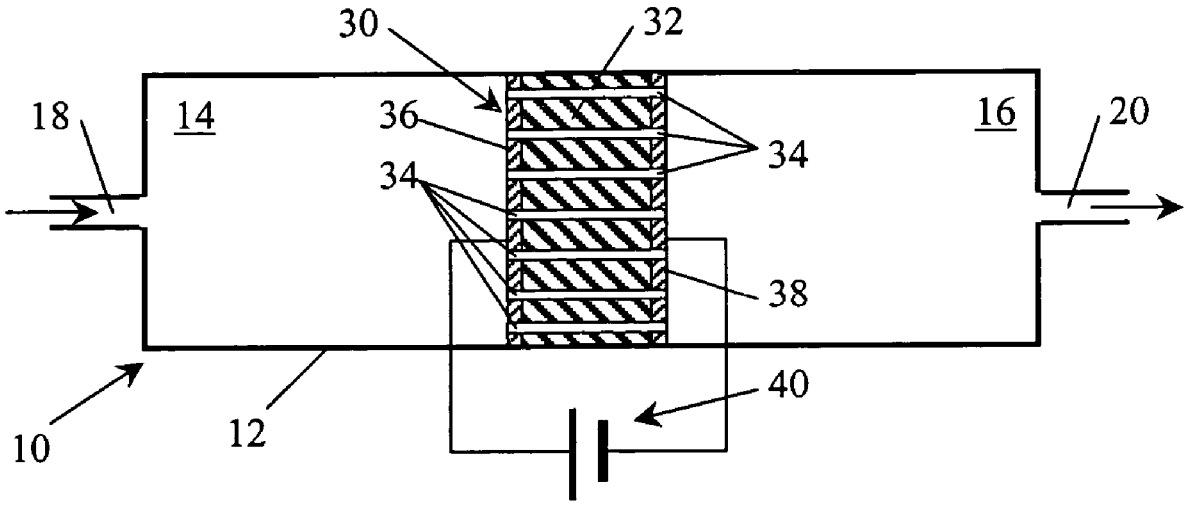
FIG. 1 is a schematic diagram of a micropump according to an embodiment of the invention.

FIG. 1 is a schematic diagram of a nanopump 10 according to one embodiment of the invention. The various components are not shown to scale relative to each other.

The nanopump 10 has a hollow housing 12 made, for example, of glass or a plastics material. Within the housing, there are two chambers, a first chamber 14 and a second chamber 16. The first chamber 14 has a first port 18 and the second chamber 16 a second port 20, for liquid flow to outside the housing.

The two chambers 14, 16 are separated by a membrane 30. The membrane 30 has a body 32, with channels 34 passing through from one side to the other. The external faces of the membrane 30, facing the first and second chambers are mounted with electrodes, a first electrode 36 facing the first chamber 14 and a second electrode 38 facing the second chamber 16. The two electrodes 36, 38 are connected up to a variable voltage source 40, to generate a potential between them.

In this preferred embodiment the body 32 is a porous anodic alumina film containing nanochannels 34. The electrodes 36, 38 are thin Au layers coated on the surfaces of both sides of the alumina film. The voltage source 40 is a DC voltage source (0-80 V).

Applying a potential across the two electrodes 36, 38 results in movement of liquid through the nanochannels 34, from one chamber to the other, e.g. from the first chamber 14 to the second 16, with more liquid entering the first chamber 14 from the first port 18 (usually from a reservoir) and liquid exiting the second chamber 16 through the second port 20. Varying the voltage controls the flow rate of the liquid.

In the preferred embodiment, the main body of the nanopump 10 consists of a porous alumina thin film (containing nano-sized channels of about 40-300 nm in diameter) with conductive surfaces (e.g. Au coating layers) on both sides of the film. Through the fabrication of the nanochannels in (the alumina film) and subsequent annealing and surface activation processes, high-efficiency micro- or nanopumps are made. The nanofluidic flow through the nanochannels of the alumina thin films is driven by an electric field with no moving parts.

There are several potential applications of nanopumps based on porous alumina thin films, as embodied, inter alia, Liquid drug delivery with fully controllable, large dynamic range of pumping rates;

Microfluidics and nanomachine applications;

Pumps for inks of electronic papers; and

Micro-electronic cooling.

Generally, (dipolar) surface charges exist on the surfaces of alumina films. The surface charges mainly come from special surface properties of the alumina and material structures. An electrolyte fluid, such as water, forms a charge double layer at the interface between the surface and the solution. This is because the surface charge attracts oppositely charged ions from the solution. An external electrical field forces the opposing ions in this electric double layer to move, thus dragging the fluid along and through the channels. This is an electro-osmotic driving force.

Since the electro-osmotic driving force is a surface force, larger surface areas are preferred; large numbers of nanochannels present a large total surface area and thus present a high surface driving force. This advantage can translate into higher efficiency and a lower operating voltage for a fixed flow rate.

More specifically, the mechanism for the high efficiency of the pumping effect in the nanochannels 34 of the anodic alumina 32 is believed to be due mainly to the size effect of the small channels 34 and the special surface chemical state of the anodic aluminium oxide (AAO). According to the classical theory of the electro-osmosis effect, material surfaces are generally charged (positive or negative). For porous alumina made by an anodisation technique, the inner walls of the nanochannels are positively charged because of the existence of oxygen vacancies. Anions such $OH^-$ (in de-ionised water) are attracted to the surface, forming an electric double layer in the area separating the solid surface and the liquid phase. The electric double layer neutralizes and shields the charged alumina surface.

The electric potential in the plane separating the mobile and immobile parts of the double layer is referred to as the zeta potential ($\zeta$), which is an important factor in influencing the pumping effect of the nanochannels 34. When an electric field is applied parallel to the channels, forces are exerted on both parts of the double layer. The mobile part of the ionic layer moves under the influence of the electric field, carrying solvent e.g. water molecules with it. This results in the movement of the solvent along the channels 34. The electro-osmotic velocity $v_E$, (the distance of the solution transported per unit time) is given by $$v_E = \frac{\varepsilon\zeta E}{4\pi\eta}, \tag{1}$$

where $\epsilon$ and $\eta$ are the dielectric constant ($6.9\times10^{-10}$ $C^2$ $N^{-1}m^{-3}$ for anodic alumina) and the viscosity of the solution ($1\times10^{-3}$ kg/ms for water), respectively, and E the applied electric field.

The flow rate q, of a single channel is described by $$q = \frac{\pi \nabla P}{8\eta} a^4, \text{ or} \tag{2}$$

$$\nabla P = \frac{dP}{dZ} = \frac{8\eta q}{\pi a^4}, \tag{3}$$

where a is the radius of the channel, and ∇P the pressure gradient along the channel (atm/V) generated by the applied field. If the channel radius is 25 nm, ∇P ~0.1 atm/V. This high-pressure difference is gained from the size effect of the channels.

Figure 2:
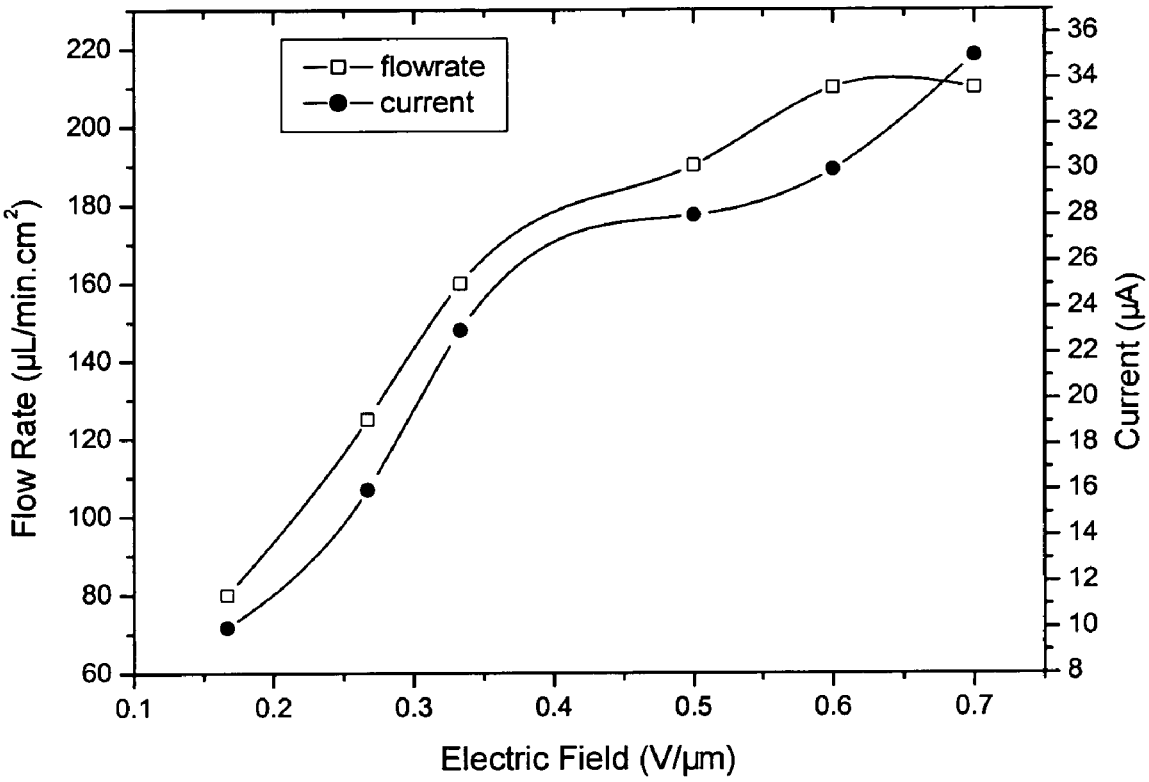
FIG. 2 is a graph showing the relationship between flow rates, applied voltages and currents for a micropump embodiment of the present invention.

The flow rate of fluid through the alumina nanochannels 34 is determined by the applied electric potential and the current. FIG. 2 is a graph showing data (flow rate, applied voltages and currents) measured from a micropump made with a porous alumina film 32, having an anodic aluminium oxide film annealed at a low temperature of 120° C. without using activation treatment. The nanochannel diameters were about 50 nm. The effective alumina film area containing channels for the micropump was 0.2 $cm^2$. The AAO film is about 30 μm thick. The porous alumina film was prepared by anodising aluminium foil in oxalic acid. The maximum flow rate of about 210 μL/(min·$cm^2$) was obtained at 18 V. Gas bubbles appeared when the voltage was above 20 V, thus limiting any further increase in the applied voltage, for water at atmospheric pressure.

Figure 3:
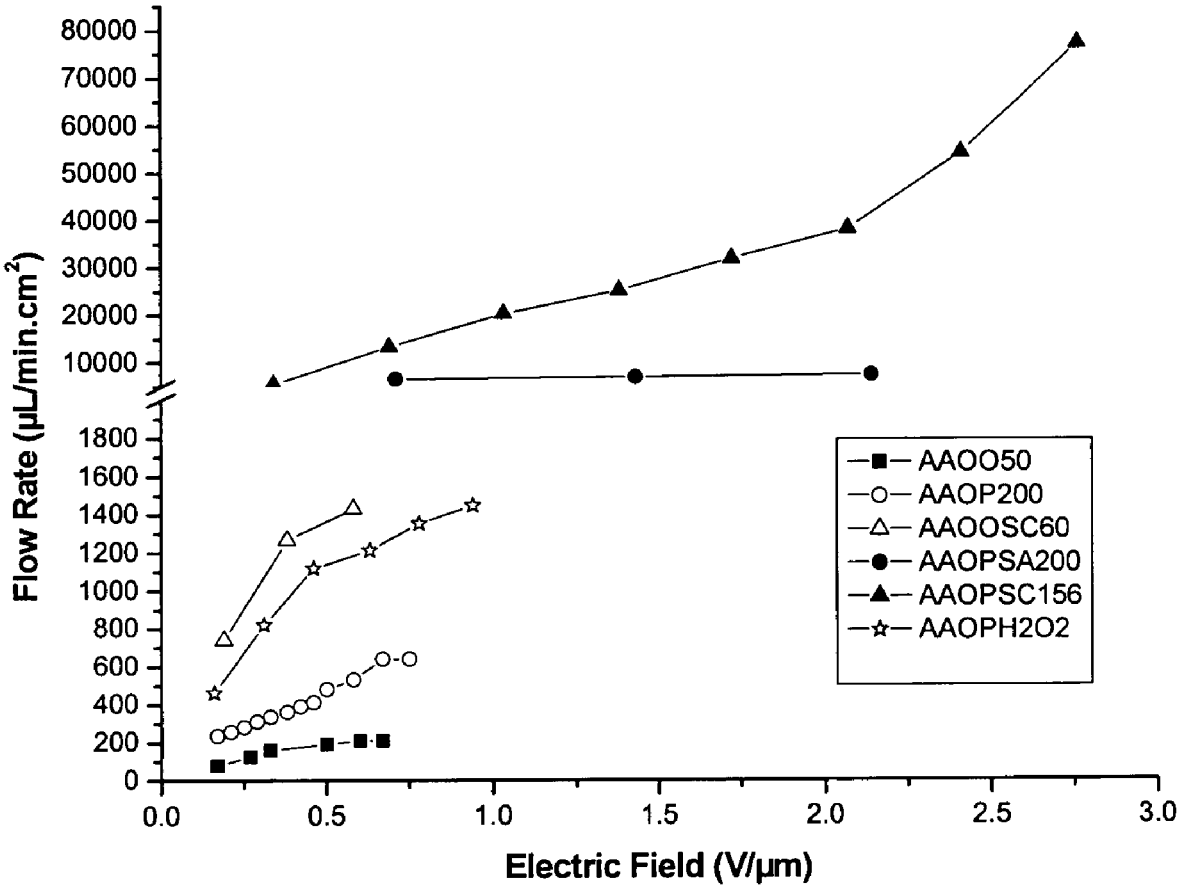
FIG. 3 is a graph showing the relationship between flow rates and electric field for a micropump embodiment of the present invention.

FIG. 3 is a graph showing the relationship between the flow rate and electric field for different micropumps made of the following porous alumina films:

AAOO50: $D_{pore}$=50 nm, 30 μm thick, no special treatment;

AAOP200: $D_{pore}$=200 nm, 120 μm thick, no special treatment;

AAOOSC60: $D_{pore}$=60 nm; 52 μm thick, activated by strong oxidant of concentrated $H_2SO_4$ and $Na_2Cr_2O_7$;

AAOPSA200: $D_{pore}$=200 nm, 25 μm thick, treated by silica sol-gel; and

AAOPSC156: $D_{pore}$=156 nm, 14.5 μm thick, treated by strong oxidant of concentrated $H_2SO_4$ and $Na_2Cr_2O_7$;

AAOPH2O2: $D_{pore}$=130 nm, 32 μm thick, treated in $H_2O_2$ (35%) and heat-annealed at 600° C.;

where $D_{pore}$ means the average diameter of the pores of the AAO film.

The maximum flow rate of more than 50 millilitres/min·$cm^2$ was obtained at 30 V for the sample AAOPSC156 (which was treated with $H_2SO_4$ and $Na_2Cr_2O_7$). Gas bubbles appeared when the voltage was above 30 V.

With regard to the data shown in FIG. 3 it can be seen that for samples AAOO50 and AAOP200, which have no special treatment, their flow rates are generally below 1000 μL/min·$cm^2$. AAOOSC60, which is activated by the strong oxidant concentrated $H_2SO_4$ and $Na_2Cr_2O_7$, and AAOPH2O2, which is treated in $H_2O_2$ and heat-annealed, have increased flow rates, while those AAO films (AAOPSA200 and AAOPSC156) which contain large pores (156-200 nm) and are treated by the same strong oxidant or by silica sol-gel show large increases in the flow rate.

Figure 4:
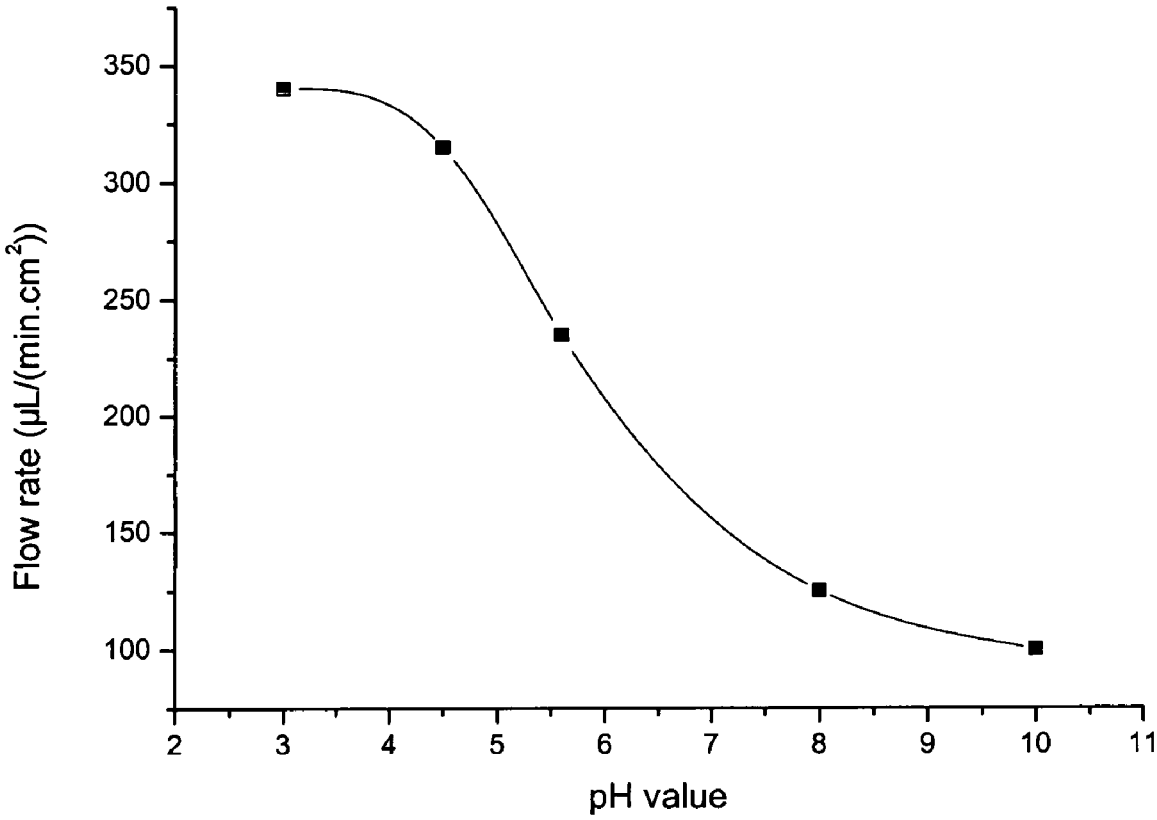
FIG. 4 is a graph showing the flow rates of a nanopump embodiment of the present invention influenced by pH values.

The flow rate of fluid through the alumina channels also strongly depends on its pH value. Increasing the amount of $OH^-$ ions in aqueous solution causes an increase in the number of $OH^-$ ions in the stern layer (the immobile part of the electric double layer), and therefore decreases the ζ value. This results in a decrease in the flow rate within the channels 34. The flow rate increases with a low pH solution, which can be clearly seen in the graph of FIG. 4. The applied voltage was fixed at 20 V. The porous alumina film, contained nanochannels with diameters of about 50 nm, and was prepared by anodising aluminium foil in oxalic acid. Its working area was 0.2 $cm^2$. The AAO film was about 30 μm thick.

Figure 5:
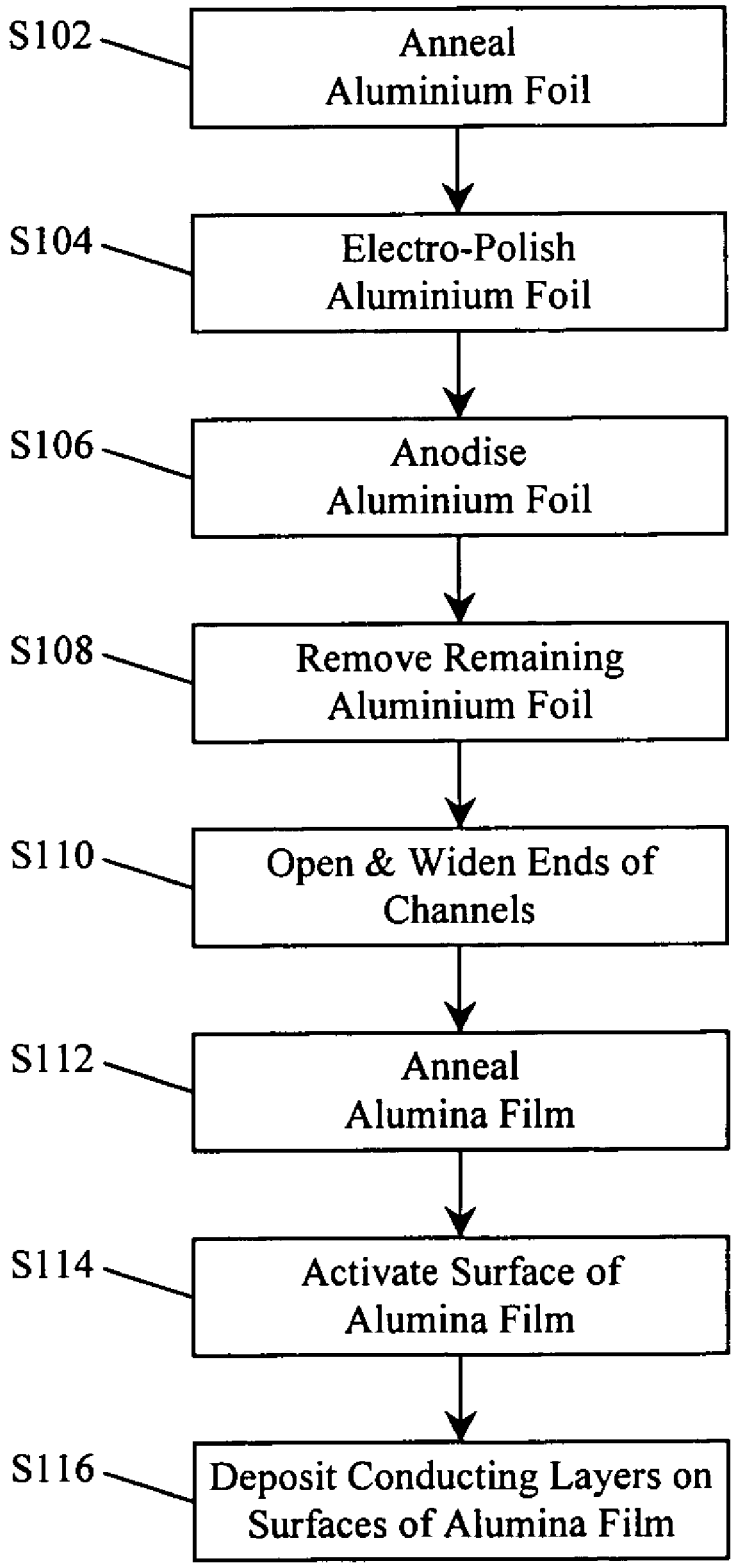
FIG. 5 is a flowchart relating to the manufacture of an alumina thin film according to an embodiment of the invention.

The present invention also provides a method of making a suitable nanopump membrane, exemplified here as a porous alumina thin film membrane, as described below with reference to the flowchart of FIG. 5.

The starting material is aluminium foil with a thickness of 0.2-0.3 mm. The aluminium foil is annealed (step S102), in this example at 500° C. in a vacuum for three hours, in order to reduce the density of defects. The foil is electro-polished (step S104), for example in a $C_2H_5OH$ solution mixed with $HClO_4$ (volume ratio 9:1).

The aluminium foil is anodised (step S106). Here, two examples (making small and large diameter channels) are given.

i) For the synthesis of a porous alumina film to create channels with diameters of about 50 nm, anodisation was carried out in 0.3M oxalic acid at 12° C. The voltage was kept at about 40 V.

ii) For a porous alumina film to create channels with diameters of about 200 nm, the anodisation was carried out in 0.3M phosphoric acid at 1° C. The voltage was kept at about 160 V.

The range of channel diameter is preferably from 40 to 300 nm, more preferably 100 to 200 nm.

Figure 6:
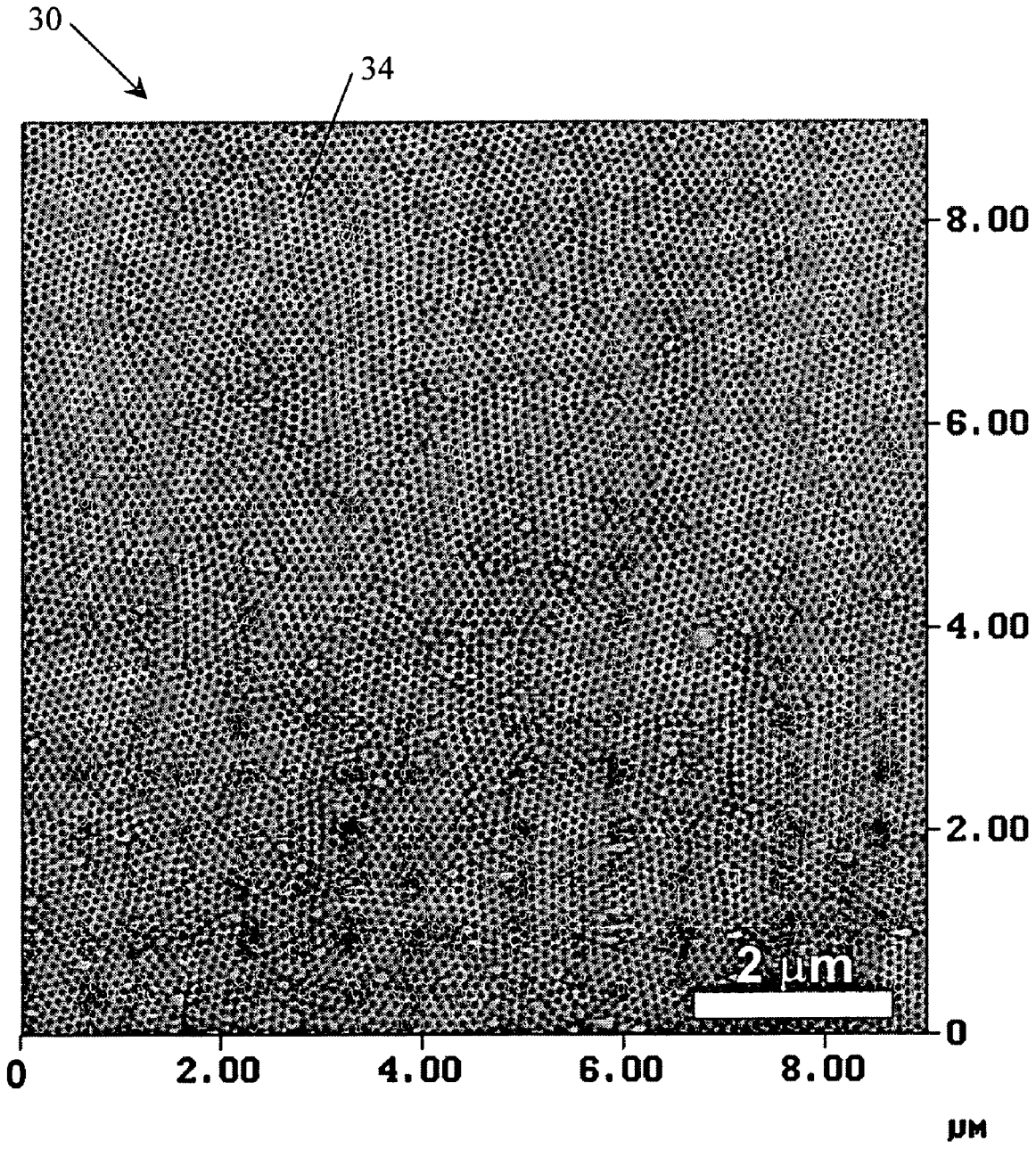
FIG. 6 is an atomic force microscopy image showing the surface morphology of a porous alumina film anodised in oxalic acid.

The thickness of anodised alumina is determined by the anodising time. For example, 12 hour anodisation can result in a 50 μm thick porous alumina film. FIG. 6 is an atomic force microscopy image showing the surface morphology of a porous alumina film 32 anodised in oxalic acid.

After the anodisation (step S106), the remaining aluminium foil is removed (step S108), for example in a saturated $CuCl_2$/HCl solution. The ends of the channels formed in the alumina film are opened and widened (step S110), for instance by chemical etching in an aqueous phosphoric acid. A typical thickness of the resultant alumina film with channel diameters of about 50 nm may be about 30 μm. Typical thicknesses for an alumina film containing large diameter channels, e.g. 200 nm, may be around 15, 25 or 50 μm.

To achieve a better performance for the nanopumps, the alumina film can be annealed (step S112), for example at a temperature above 600° C. for 2 to 10 hours in air. In this annealing process, the alumina film is homogenised and its structure and mechanical properties are stabilised.

The surface of the alumina film is activated (step S114), for example by strong oxidant etching (e.g. $H_2SO_4$ (98%)+ $Na_2Cr_2O_7$ or $H_2O_2$ (35%)) at 60-80° C. for 0.5-1 hour, or silica coating with sol-gel of silica at room temperature for more than half an hour. This increases the zeta potential of the inner walls of the nanochannels. The preferred silica coating involves preparing a solution, by mixing 1.5 ml of tetraethyl orthosilicate with 1 ml of ethanol, stirring vigorously, dropping 4 ml of de-ionised (DI) water into the mixture and stirring further for at least 2 hours. The AAO membrane with open nanochannel ends on both sides is dipped into the solution for half an hour. The AAO is taken out and dried at from 30° C. to 90° C., preferably 60° C., then heat-treated at from 500° C. to 700° C., preferably 600° C. for from 1 to 3 hours, preferably 2 hours, in air.

Conducting layers (the electrodes) are deposited on the two opposing main surfaces of the alumina film (step S116). The conductive layers are usually of the same thickness, e.g. 8-12 nm thick. The conductive layers are preferably of the same material, preferably Au, or alternatively Pt. The deposit can be made, for example, by way of thermal evaporation in a vacuum.

The alumina film can then be assembled into a nanopump.

In this exemplary process of making a suitable nanopump membrane, the main steps are: anodising (step S106), annealing (step S112), activating (step S114) and electrode depositing (step S116).

Figure 7:
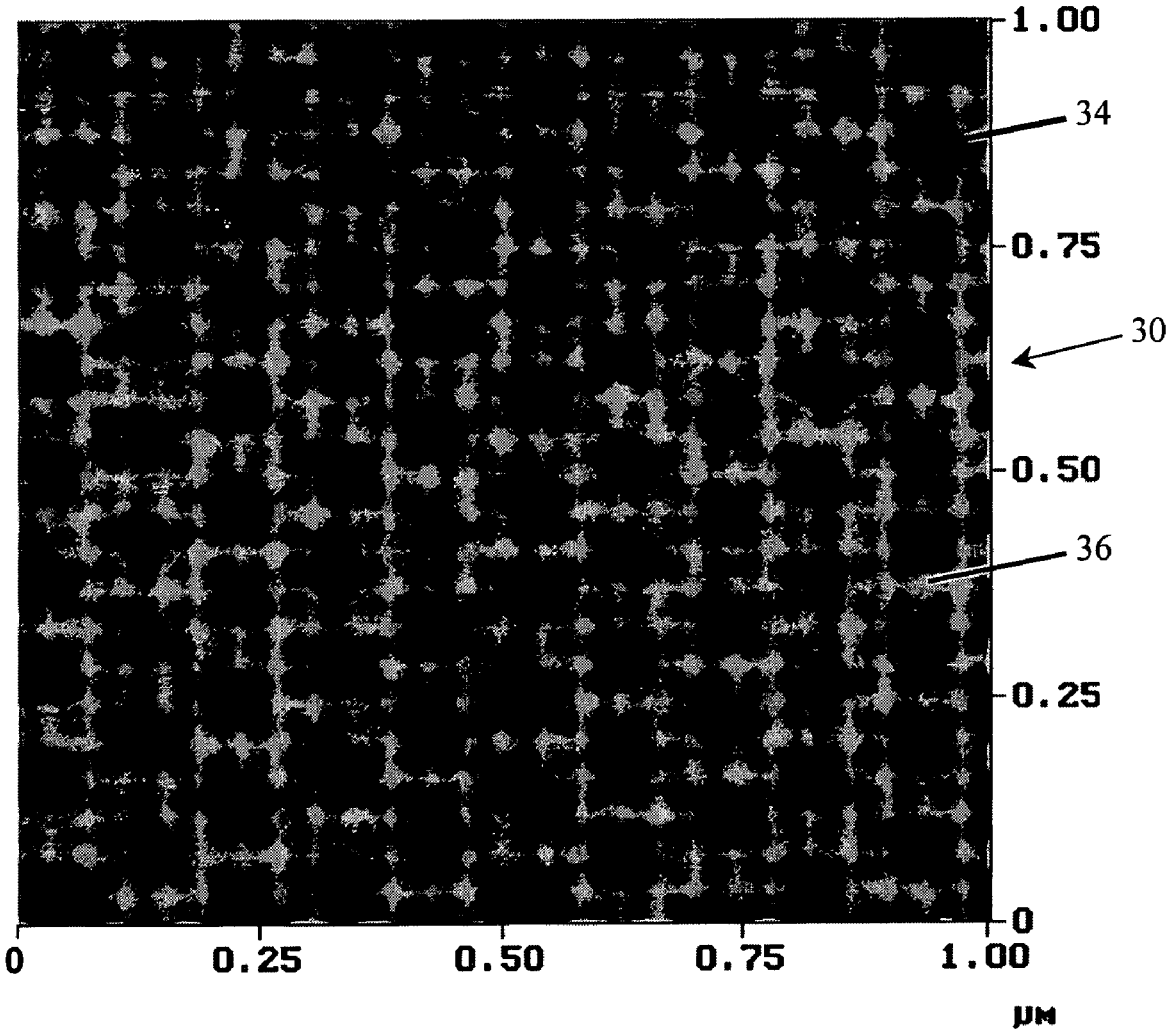
FIG. 7 is an atomic force microscopy image showing the surface morphology of the anodised porous alumina film coated with Au.
Figure 8:
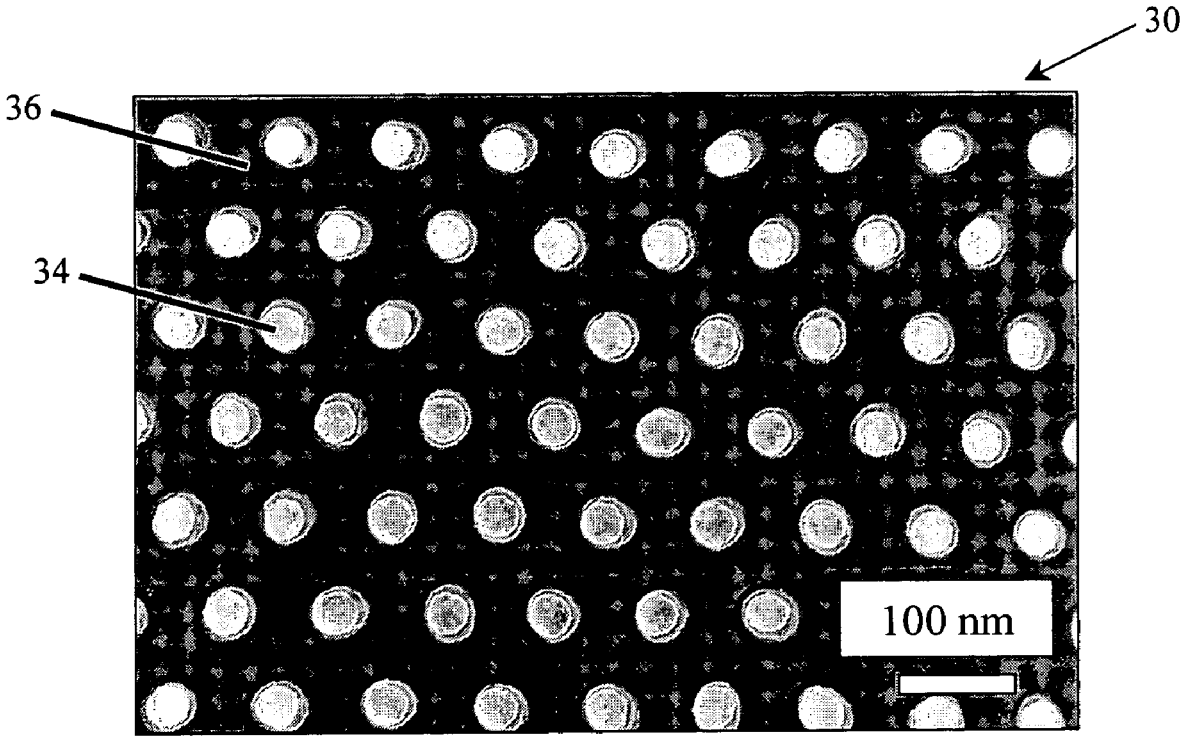
FIG. 8 is a transmission electron microscopy image of the porous alumina film of FIG. 7.

FIG. 7 shows the surface morphology of an alumina film membrane 30 after the deposition of Au electrodes 36, 38 (channel diameter=50 nm). FIG. 8 is a transmission electron microscopy image showing the detailed structure of the alumina film membrane 30 of FIG. 7, after deposit of the Au. Nanochannels with diameters of about 50 nm are arranged regularly in the alumina film.

Proper treatment of the membrane material gives rise to successful fabrication of high-efficiency micro- or nanopumps. The structure of alumina film is mainly amorphous. The channel size is preferably uniform, and the channels should not be interrupted or blocked inside the film. The pore diameters of the nanochannels near the surface can usefully be widened by chemical etching before coating the conducting layers. The conducting coatings on two sides of the film surfaces should be uniform. The thicker the conducting coatings the better the nanopump performance. However, the open ends of the channels should not be obstructed or blocked by the conducting layers. The annealing temperature and the activation process are the most critical factors affecting the performance of the nanopumps. In addition to alumina films, substrates of other porous non water-soluble materials e.g. porous silicon and porous metals, coated with alumina and treated in accordance with the methods discussed herein could also be used.

Preferred embodiments use porous alumina thin films for nanopumps, which thin films are treated by different surface modification processes, i.e., the activation and surface coating, including filling the nanochannels with other porous materials, such as silica. The flow rate of water through the alumina thin film can be continuously tuned by the intensity of the electric field. A flow rate (of de-ionised water) up to 50 millilitres/(min·cm$^2$) has been achieved. The surface treatment and surface coatings on the inside walls of the nanochannels are critical in determining efficiency.

The pumping membrane is typically less than 1 cm$^2$ in the surface area of a single main surface. However, larger membranes may be grown on a mesh.

The present invention provides novel nanopumps based on porous alumina thin films, and their fabrication process. Depending on the fabrication conditions of the nanochannels in the alumina films and the subsequent treatments and annealing process, high-efficiency nanopumps can be made. The nanofluidic flow through the nanochannels of the alumina thin films, based on the mechanism of electro-osmosis, is driven by an electric field with no moving parts. The flow rate of water through the alumina thin film can be continuously tuned by the intensity of the electric field. The invented technology enables the control of the fluid flow rate through nanochannels of porous alumina thin films.

The preferred embodiments use porous alumina thin film to build high-efficiency micro- or nanopumps with fully controllable flow rate and flow directions. Active porous alumina thin film has conductive Au layers deposited on both sides, with well-controlled nanochannel diameters. Annealing, homogenisation, stabilisation of the alumina film, and activation of the nanochannels in terms of their electro-osmotic characteristic (the zeta potential), leads to improved results. The advantages of these thin film nanopumps rely on the unique combination of the nano-sized one-dimensional channel structure of the alumina thin films, which enables low voltage operation of the pump, with an enhanced electro-osmotic effect.

Compared with previous electro-osmotic pumps, the present invention presents the following features: (1) Low operating voltages, (2) high maximum flow rate per unit area, (3) low cost of fabrication, (4) thickness comparable to a thin membrane (<50 microns) as opposed to the centimetre scale for the conventional electro-osmotic pumps, and (5) it is suitable for both small and large area applications.

The invention claimed is:

1. A membrane for a micropump or nanopump, comprising:

a membrane body having a first side and a second side;

channels passing through said body from the first side to the second side; and a first electrode mounted on said first side and a second electrode mounted on the second side, wherein the body comprises a porous anodized alumina thin film and silica coated, activated channels.

2. A membrane according to claim 1, wherein the channels comprise nanochannels.

3. A membrane according to claim 2, wherein the nanochannels are in the range of from 40-300 nm in diameter.

4. A membrane according to claim 1, wherein the channels are generally uniform in size.

5. A membrane according to claim 1, wherein the body is 50 μm or less thick, from first side to second side.

6. A membrane according to claim 1, wherein the first and second electrodes each have a thickness and the thickness of the first electrode is the same as that of the second electrode.

7. A membrane according to claim 1, wherein the first and second electrodes are each in the range of from 8-12 nm thick.

8. A membrane according to claim 1, wherein the electrodes are of Au or Pt.

9. A membrane according to claim 1, wherein the membrane body comprises a material that has been anodised and annealed prior to mounting of the electrodes.

10. A membrane according to claim 2, wherein the nanochannels are in the range of from 100-200 nm in diameter.

11. A micropump or a nanopump, comprising:

a housing containing a first fluid chamber and a second fluid chamber;

a pump membrane separating the first and second fluid chambers; and a voltage source; wherein the pump membrane comprises:

a membrane body having a first side and a second side, and comprising a porous anodized alumina thin film;

silica coated, activated channels passing through said body from the first side to the second side; and a first electrode mounted on said first side and a second electrode mounted on the second side; and the voltage source is connected between the first and second electrodes.

12. A micropump or a nanopump according to claim 11, being a pump for one of the group consisting of: liquid drug delivery; ink delivery; micro-electronic device cooling; and microfluidics or nanomachine applications.

13. A method of fabricating a porous anodized alumina thin film membrane for a micro- or nanopump, the membrane having silica coated, activated channels therethrough and two opposing surfaces, the method comprising:

annealing a membrane body;

activating surfaces of channels through the membrane body with a silica coating and;

mounting electrodes on opposing surfaces of the membrane body.

14. A method according to claim 13, further comprising providing the membrane body by anodising a starting material.

15. A method according to claim 14, wherein the starting material comprises aluminium foil.

16. A method according to claim 13, wherein annealing the membrane body comprises using thermal annealing method to harden and stabilize the membrane body.

17. A method according to claim 13, wherein annealing the membrane body comprises drying and stabilising the membrane body at a temperature above 600° C. for from 2 to 10 hours.

18. A method according to claim 13, wherein activating surfaces of channels through the membrane body comprises using a silica coating method to activate the surfaces of the channels.

19. A method according to claim 18, wherein the silica coating method comprises contacting the membrane body with a silica coating solution for from 15 to 45 minutes, drying the membrane body at from 30° C. to 90° C. then heat treating the membrane body at a temperature from 500° C. to 700° C. for from 1 to 3 hours.

20. A method according to claim 19, wherein the silica coating solution comprises a mixture of tetraethyl orthosilicate, ethanol and water.

21. A method according to claim 20, wherein the silica coating solution comprises a mixture of tetraethyl orthosilicate, ethanol and water provided in a ratio of 3:2:8, by volume.

22. A method according to claim 13, wherein mounting electrodes on the membrane body comprises depositing conducting materials on the two opposing surfaces of the membrane body.

23. A method according to claim 13, wherein the electrodes are of Au or Pt.

24. A method according to claim 13, wherein the electrodes are from 8 to 12 nm thick.

25. A method of pumping fluid using a micropump or a nanopump comprising:

a housing containing a first fluid chamber and a second fluid chamber;

a pump membrane separating the first and second fluid chambers; and a voltage source, wherein the pump membrane comprises:

a membrane body, having a first side and a second side, and comprising a porous anodized alumina thin film;

silica coated, activated channels passing through said body from the first side to the second side; and a first electrode mounted on said first side and a second electrode mounted on the second side; and wherein the voltage source is connected between the first and second electrodes, the method comprising:

using the voltage source to apply a DC potential between the two electrodes to control the flow rate of fluid through the activated channels, from the first fluid chamber to the second fluid chamber.

26. A method according to claim 25, further comprising maintaining the DC potential in the range of 0 to 80 V.

* * * * *